US011681250B2

(12) United States Patent
Kabata et al.

(10) Patent No.: US 11,681,250 B2
(45) Date of Patent: Jun. 20, 2023

(54) NIP FORMER, FIXING DEVICE, AND IMAGE FORMING APPARATUS

(71) Applicants: Toshiyuki Kabata, Kanagawa (JP); Yoshiki Yamaguchi, Kanagawa (JP); Takashi Seto, Kanagawa (JP); Hiroshi Yoshinaga, Chiba (JP); Kentaro Yamashita, Shizuoka (JP); Daisuke Inoue, Tokyo (JP)

(72) Inventors: Toshiyuki Kabata, Kanagawa (JP); Yoshiki Yamaguchi, Kanagawa (JP); Takashi Seto, Kanagawa (JP); Hiroshi Yoshinaga, Chiba (JP); Kentaro Yamashita, Shizuoka (JP); Daisuke Inoue, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/900,880

(22) Filed: Sep. 1, 2022

(65) Prior Publication Data

US 2023/0093465 A1 Mar. 23, 2023

(30) Foreign Application Priority Data

Sep. 22, 2021 (JP) ..... JP2021-153761

(51) Int. Cl.
*G03G 15/20* (2006.01)

(52) U.S. Cl.
CPC ..... *G03G 15/2057* (2013.01); *G03G 15/206* (2013.01); *G03G 15/2014* (2013.01);
(Continued)

(58) Field of Classification Search
CPC ..... G03G 15/2014; G03G 15/2017; G03G 15/2053; G03G 15/2057; G03G 15/206;
(Continued)

(56) References Cited

U.S. PATENT DOCUMENTS 6,148,169 A * 11/2000 Tsukamoto ..... G03G 15/2064 399/328
8,737,894 B2 * 5/2014 Suzuki ..... G03G 15/2028 399/329
(Continued)

FOREIGN PATENT DOCUMENTS

JP S63-161472 A 7/1988
JP 2008-096929 4/2000
(Continued)

OTHER PUBLICATIONS

Extended European Search Report dated Feb. 17, 2023 in European Patent Application No. 22192341.0, 5 pages.
(Continued)

*Primary Examiner* — Joseph S Wong
(74) *Attorney, Agent, or Firm* — Xsensus LLP

(57) ABSTRACT

A nip former that forms a nip between an endless belt and a pressure rotator includes a base that is made of aluminum and has a nip forming face disposed opposite the nip. An anodic oxidation coating is treated with sealing and coats at least the nip forming face. The anodic oxidation coating has a thickness that is not smaller than 22 μm and is not greater than 45 μm and a variation in thickness that is not greater than 20 percent. The base and the anodic oxidation coating define a nip forming portion that is disposed opposite the nip. The nip forming portion has a thickness that is not smaller than 0.40 mm and is not greater than 1.20 mm.

7 Claims, 8 Drawing Sheets

(52) U.S. Cl.
CPC ..... *G03G 15/2017* (2013.01); *G03G 15/2053* (2013.01); *G03G 2215/20* (2013.01); *G03G 2215/2003* (2013.01); *G03G 2215/2048* (2013.01); *G03G 2215/2054* (2013.01)

(58) Field of Classification Search
CPC ..... G03G 2215/20; G03G 2215/2003; G03G 2215/2035; G03G 2215/2048; G03G 2215/2054
See application file for complete search history.

(56) References Cited

U.S. PATENT DOCUMENTS

| | | | | |
|---|---|---|---|---|
| 2005/0180786 | A1 | 8/2005 | Yamada et al. | |
| 2012/0155919 | A1* | 6/2012 | Cardoso | C25D 11/16 399/333 |
| 2014/0023413 | A1 | 1/2014 | Shinji et al. | |
| 2016/0342117 | A1 | 11/2016 | Minamishima et al. | |

FOREIGN PATENT DOCUMENTS

| | | | |
|---|---|---|---|
| JP | 2012-141380 | | 7/2012 |
| JP | 2014-038311 | | 2/2014 |
| JP | 2016-218098 | | 12/2016 |
| JP | 2020-134744 | | 8/2020 |
| WO | 2021/123954 | A1 | 6/2021 |

OTHER PUBLICATIONS

U.S. Appl. No. 17/761,194, filed Nov. 17, 2020, Yoshiki Yamaguchi, et al.

* cited by examiner

NIP FORMER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-153761, filed on Sep. 22, 2021, in the Japan Patent Office, the entire disclosure of which is hereby incorporated by reference herein.

BACKGROUND

Technical Field

Embodiments of this disclosure relate to a nip former, a fixing device, and an image forming apparatus.

Related Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography. The image forming apparatus performs image forming processes below. For example, a writer forms an electrostatic latent image on a surface of a photoconductive drum serving as an image bearer. A developing device develops the electrostatic latent image formed on the photoconductive drum into a visible toner image with a developer such as toner. A transfer device transfers the toner image onto a recording medium such as a sheet and a recording sheet so that the recording medium bears the toner image, A fixing device fixes the toner image on the recording medium.

For example, the fixing device includes a heater, a fixing rotator, and a pressure rotator. The heater heats and retains the fixing rotator at a predetermined temperature. The pressure rotator presses against the fixing rotator to form a nip between the fixing rotator and the pressure rotator. While the fixing rotator and the pressure rotator sandwich and convey the recording medium bearing the unfixed toner image through the nip, the fixing rotator and the pressure rotator fix the toner image on the recording medium under heat and pressure.

SUMMARY

This specification describes below an improved nip former that forms a nip between an endless belt and a pressure rotator. In one embodiment, the nip former includes a base that is made of aluminum and has a nip forming face disposed opposite the nip. An anodic oxidation coating is treated with sealing and coats at least the nip forming face. The anodic oxidation coating has a thickness that is not smaller than 22 μm and is not greater than 45 μm and a variation in thickness that is not greater than 20 percent. The base and the anodic oxidation coating define a nip forming portion that is disposed opposite the nip. The nip firming portion has a thickness that is not smaller than 0.40 mm and is not greater than 1.20 mm.

This specification further describes an improved fixing device. In one embodiment, the fixing device includes an endless belt that is formed into a loop, a pressure rotator that is disposed outside the loop formed by the endless belt and disposed opposite the endless belt, a heater that heats the endless belt, and the nip former described above that is disposed within the loop formed by the endless belt. The nip former forms a fixing nip between the endless belt and the pressure rotator.

This specification further describes an improved image forming apparatus. In one embodiment, the image forming apparatus includes an image forming device that forms an image and the fixing device described above that fixes the image on a recording medium.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
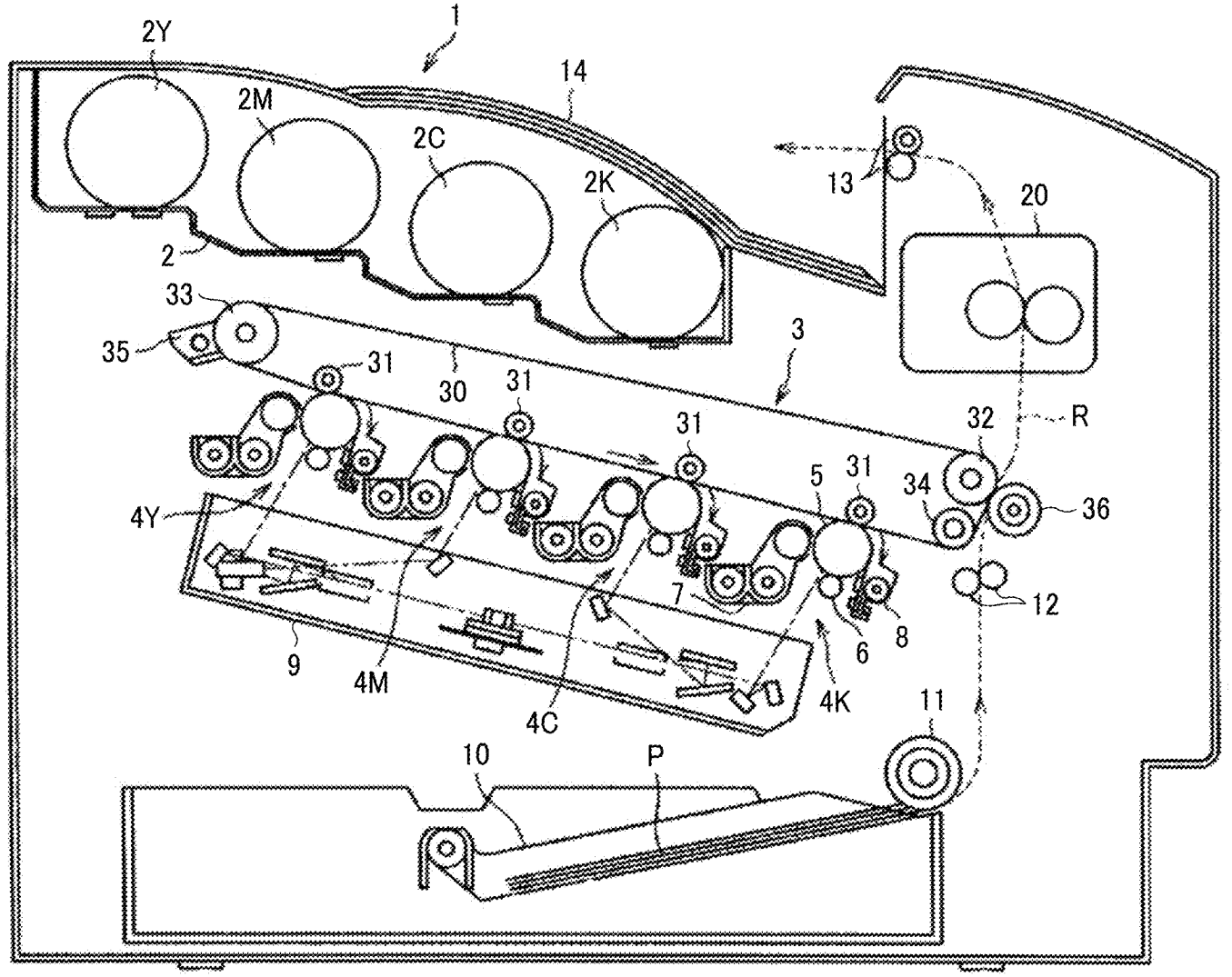
FIG. 1 is a schematic cross-sectional view of an image forming apparatus according to an embodiment of the present disclosure.

The accompanying drawings are intended to depict embodiments of the present invention and should not be interpreted to limit the scope thereof The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Referring to drawings, a description is provided of constructions of a nip former, a fixing device, and an image forming apparatus according to embodiments of the present disclosure, respectively. The technology of the present disclosure is not limited to the embodiments described below and may be modified within scopes suggested by those skilled in art with other embodiments, addition, modification, deletion, and the like. The technology of the present disclosure encompasses various embodiments that achieve operations and advantages of the technology of the present disclosure.

Referring to FIG. 1, a description is provided of an overall construction and operations of an image forming apparatus 1 according to an embodiment of the present disclosure.

As illustrated in FIG. 1, the image forming apparatus 1 is a color laser printer. The image forming apparatus 1 includes four image forming devices 4Y, 4M, 4C, and 4K that are disposed in a center of a body of the image forming apparatus 1. The image forming devices 4Y, 4M, 4C, and 4K have a similar construction. However, the image forming devices 4Y, 4M, 4C, and 4K contain developers in different colors, that is, yellow (Y), magenta (M), cyan (C), and black (K), respectively, which correspond to color separation components for a color image.

For example, each of the image forming devices 4Y, 4M, 4C, and 4K includes a photoconductor 5, a charger 6, a developing device 7, and a cleaner 8. The photoconductor 5 is drum-shaped and serves as a latent image bearer. The charger 6 charges a surface of the photoconductor 5. The developing device 7 supplies toner to the surface of the photoconductor 5. The cleaner 8 cleans the surface of the photoconductor 5. FIG. 1 assigns reference numerals to the photoconductor 5, the charger 6, the developing device 7, and the cleaner 8 of the image forming device 4K that forms a black toner image. Reference numerals for elements of the image forming devices 4Y, 4M, and 4C are omitted.

Below the image forming devices 4Y, 4M, 4C, and 4K is an exposure device 9 that exposes the surface of the photoconductor 5. The exposure device 9 includes a light source, a polygon mirror, an f-θ lens, and a reflection mirror. The exposure device 9 irradiates the surface of each of the photoconductors 5 with a laser beam according to image data.

Above the image forming devices 4Y, 4C, 4M, and 4K is a transfer device 3. The transfer device 3 includes an intermediate transfer belt 30 serving as a transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As the secondary transfer backup roller 32 is driven and rotated, the intermediate transfer belt 30 revolves around or rotates in a direction indicated by arrow in FIG. 1.

The four primary transfer rollers 31 and the photoconductors 5 sandwich the intermediate transfer belt 30 to form primary transfer nips between the photoconductors 5 and the intermediate transfer belt 30, respectively. Each of the primary transfer rollers 31 is coupled to a power supply that applies at least one of a predetermined direct current (DC) voltage and a predetermined alternating current (AC) voltage to each of the primary transfer rollers 31.

The secondary transfer roller 36 and the secondary transfer backup roller 32 sandwich the intermediate transfer belt 30 to form a secondary transfer nip between the secondary transfer roller 36 and the intermediate transfer belt 30. Like the primary transfer rollers 31, the power supply is also coupled to the secondary transfer roller 36 to apply at least one of the predetermined direct current (DC) voltage and the predetermined alternating current (AC) voltage to the secondary transfer roller 36.

The belt cleaner 35 includes a cleaning brush and a cleaning blade that come into contact with the intermediate transfer belt 30. The belt cleaner 35 is coupled to a waste toner conveyance tube that extends from the belt cleaner 35 and communicates with an inlet of a waste toner container.

The image forming apparatus 1 further includes a bottle housing 2 that is disposed in to an upper portion of the body of the image forming apparatus 1. The bottle housing 2 accommodates four toner bottles 2Y, 2M, 2C, and 2K that contain toners to be supplied to the image forming devices 4Y 4M, 4C, and 4K, respectively, and are detachably attached to the bottle housing 2. The toner bottles 2Y, 2M, 2C, and 2K are coupled to toner supply tubes that are disposed between the toner bottles 2Y, 2M 2C, and 2K and the developing devices 7 so that the toners are supplied from the toner bottles 2Y, 2M, 2C, and 2K to the developing devices 7 through the toner supply tubes, respectively.

In a lower portion of the body of the image forming apparatus 1 are a sheet feeding tray 10 (e.g., a paper tray), a feed roller 11, and the like. The sheet feeding tray 10 stores sheets P serving as recording media. The feed roller 11 feeds and conveys a sheet P of the sheets P stored in the sheet feeding tray 10, The recording media include plain paper, thick paper, a postcard, an envelope, thin paper, coated paper, art paper, tracing paper, and an overhead projector (OUP) transparency. Optionally, the image forming apparatus 1 may include a bypass feeder (e.g., a bypass tray).

The image forming apparatus 1 further includes a conveyance path R that is disposed in the body of the image forming apparatus 1. The sheet P is conveyed from the sheet feeding tray 10 through the conveyance path R via the secondary transfer nip formed between the intermediate transfer belt 30 and the secondary transfer roller 36 to an outside of the image forming apparatus 1. The conveyance path R is provided with a registration roller pair 12 that is disposed upstream from the secondary transfer roller 36 in a sheet conveyance direction in which the sheet P is conveyed. The registration roller pair 12 serves as a conveyor that conveys the sheet P to the secondary transfer nip.

Downstream from the secondary transfer roller 36 in the sheet conveyance direction is a fixing device 20 that fixes an unfixed toner image transferred from the intermediate transfer belt 30 onto the sheet P thereon. The conveyance path R is further provided with an output roller pair 13 that is disposed downstream from the fixing device 20 in the sheet conveyance direction. The output roller pair 13 ejects the sheet P onto the outside of the image forming apparatus 1. The image forming apparatus 1 further includes an output tray 14 that is disposed atop the body of the image forming apparatus 1. The output tray 14 stocks the sheet P ejected onto the outside of the image forming apparatus 1.

Referring to FIG. 1, a description is provided of basic operations of the image forming apparatus 1 according to the embodiment to perform image formation.

When image formation starts, that is, when the image forming apparatus 1 receives a print job, a driver disposed in the body of the image forming apparatus 1 drives and rotates the photoconductor 5 of each of the image forming devices 4Y. 4M, 4C, and 4K clockwise in FIG. 1 so that the charger 6 charges the surface of the photoconductor 5 uniformly at a predetermined polarity. The exposure device 9 emits a laser beam that irradiates the charged surface of the photoconductor 5, forming an electrostatic latent image on the surface of the photoconductor 5 of each of the image forming devices 4Y, 4M, 4C, and 4K.

The exposure device 9 uses image data to expose the photoconductor 5. The image data is monochrome image data created by decomposing desired full color image data into yellow, magenta, cyan, and black image data. The developing device 7 supplies toner to the electrostatic latent image formed on the photoconductor 5, visualizing the electrostatic latent image as a visible toner image.

Additionally, when image formation starts, the secondary transfer backup roller 32 is driven and rotated counterclockwise in FIG. 1, rotating the intermediate transfer belt 30 in the direction indicated by arrow in FIG. 1. Each of the primary transfer rollers 31 is applied with a voltage at a polarity opposite a polarity of charged toner under one of a constant voltage control and a constant current control. Thus, a transfer electric field is created at the primary transfer nip formed between the photoconductor 5 and the intermediate transfer belt 30 abutting on the primary transfer roller 31.

Thereafter, when the toner images in yellow, magenta, cyan, and black, which are formed on the photoconductors 5, reach the primary transfer nips in accordance with rotation of the photoconductors 5, respectively, the toner images formed on the photoconductors 5 are transferred onto the intermediate transfer belt 30 successively by the transfer electric fields created at the primary transfer nips such that the toner images are superimposed on the intermediate transfer belt 30, forming a full color toner image. Thus, the full color toner image is borne on an outer circumferential surface of the intermediate transfer belt 30. The cleaners 8 remove toner failed to be transferred onto the intermediate transfer belt 30 and therefore remaining on the photoconductors 5 therefrom, respectively. Thereafter, a discharger of each of the image forming devices 4Y, 4M, 4C, and 4K discharges the surface of the photoconductor 5, initializing a surface potential of the photoconductor 5.

In the lower portion of the body of the image forming apparatus 1, the feed roller 11 starts being driven and rotated, feeding a sheet P from the sheet feeding tray 10 to the conveyance path R. The registration roller pair 12 conveys the sheet P sent to the conveyance path R to the secondary transfer nip formed between the secondary transfer roller 36 and the intermediate transfer belt 30 pressed by the secondary transfer backup roller 32 at a time when the full color toner image formed on the intermediate transfer belt 30 reaches the secondary transfer nip. The secondary transfer roller 36 is applied with a transfer voltage having a polarity opposite the polarity of the charged toner of the full color toner image formed on the intermediate transfer belt 30, thus creating a transfer electric field at the secondary transfer nip.

Thereafter, when the full color toner image formed on the intermediate transfer belt 30 reaches the secondary transfer nip in accordance with rotation of the intermediate transfer belt 30, the toner images in yellow, magenta, cyan, and black that form the full color toner image formed on the intermediate transfer belt 30 are transferred onto the sheet P collectively by the transfer electric field created at the secondary transfer nip. The belt cleaner 35 removes toner failed to be transferred onto the sheet P and therefore remaining on the intermediate transfer belt 30 therefrom. The removed toner is conveyed and collected into the waste toner container.

Thereafter, the sheet P transferred with the full color toner image is conveyed to the fixing device 20 that fixes the full color toner image on the sheet P. The sheet P is ejected onto the outside of the image forming apparatus 1 by the output roller pair 13 and stocked on the output tray 14.

The above describes image formation to form the full color toner image on the sheet P. Alternatively, one of the four image forming devices 4Y, 4M, 4C, and 4K may be used to form a monochrome toner image or two or three of the four image forming devices 4Y, 4M, 4C, and 4K may be used to form a bicolor toner image or a tricolor toner image, A description is provided of a construction of a fixing device according to an embodiment of the present disclosure, which is incorporated in the image forming apparatus 1.

The fixing device according to the embodiment of the present disclosure includes an endless belt, a pressure rotator, a heater, and a nip former. The pressure rotator is disposed outside a loop formed by the endless belt and disposed opposite the endless belt. The heater heats the endless belt. The nip former is disposed within the loop formed by the endless belt. The nip former and the pressure rotator form a fixing nip between the endless belt and the pressure rotator.

A belt that is endless is referred to as a fixing belt, an endless belt, or a belt.

According to the embodiments of the present disclosure, a lubricant is applied between an inner face of the endless belt and the nip former.

For example, silicone oil, silicone grease, fluorine oil, fluorine grease, or the like is used as the lubricant.

The lubricant retains proper sliding of the endless belt over the nip former. Hence, the fixing device and an image forming apparatus incorporating the fixing device form high quality images over a prolonged period of time, The pressure rotator is a roller, for example. As the pressure rotator rotates, the endless belt heated by the heater also rotates in accordance with rotation of the pressure rotator.

While the endless belt that is heated by the heater and the pressure rotator that rotates convey the sheet P transferred with the toner image through the fixing nip formed between the endless belt and the pressure rotator, the endless belt and the pressure rotator fix the toner image on the sheet P.

Figure 2:
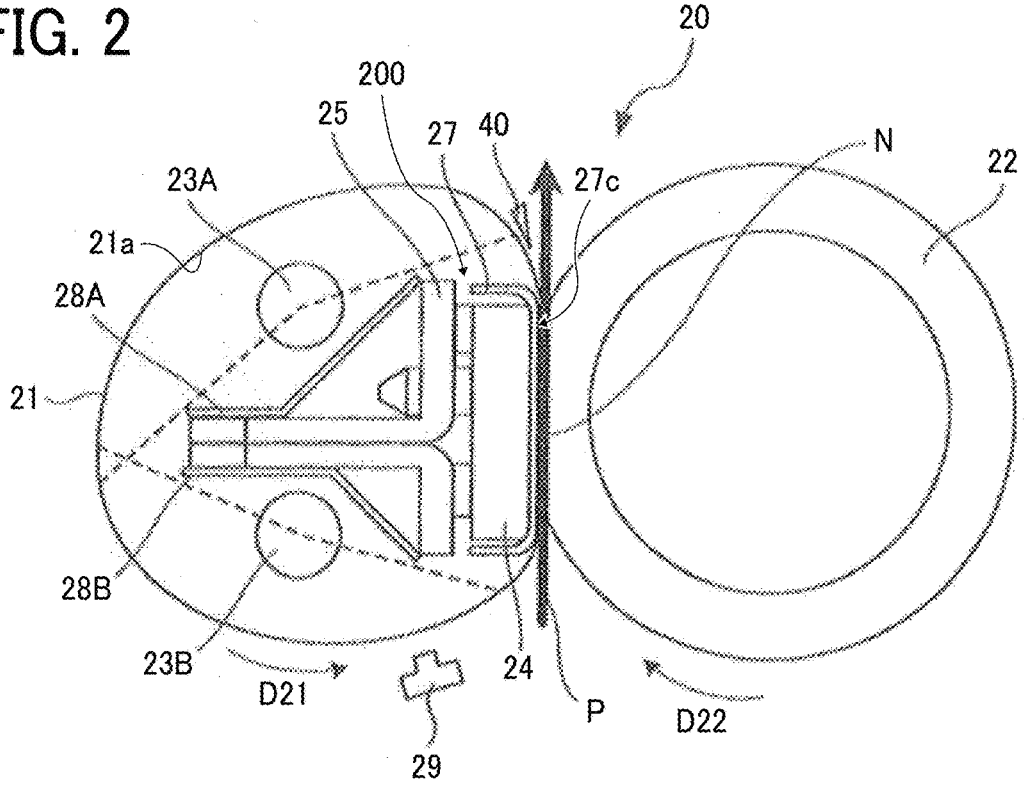
FIG. 2 is a schematic cross-sectional view of a fixing device according to an embodiment of the present disclosure, which is incorporated in the image forming apparatus depicted in FIG. 1.
Figure 3:
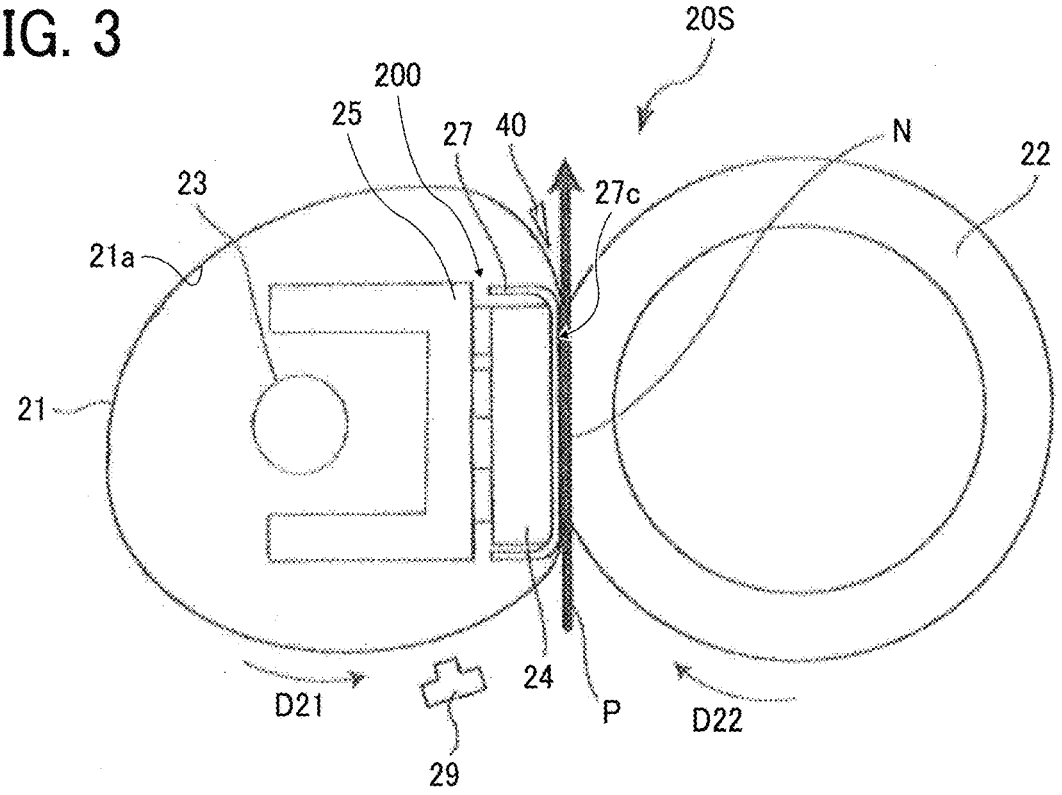
FIG. 3 is a schematic cross-sectional view of a fixing device according to another embodiment of the present disclosure, which is installable in the image forming apparatus depicted in FIG. 1.
Figure 4:
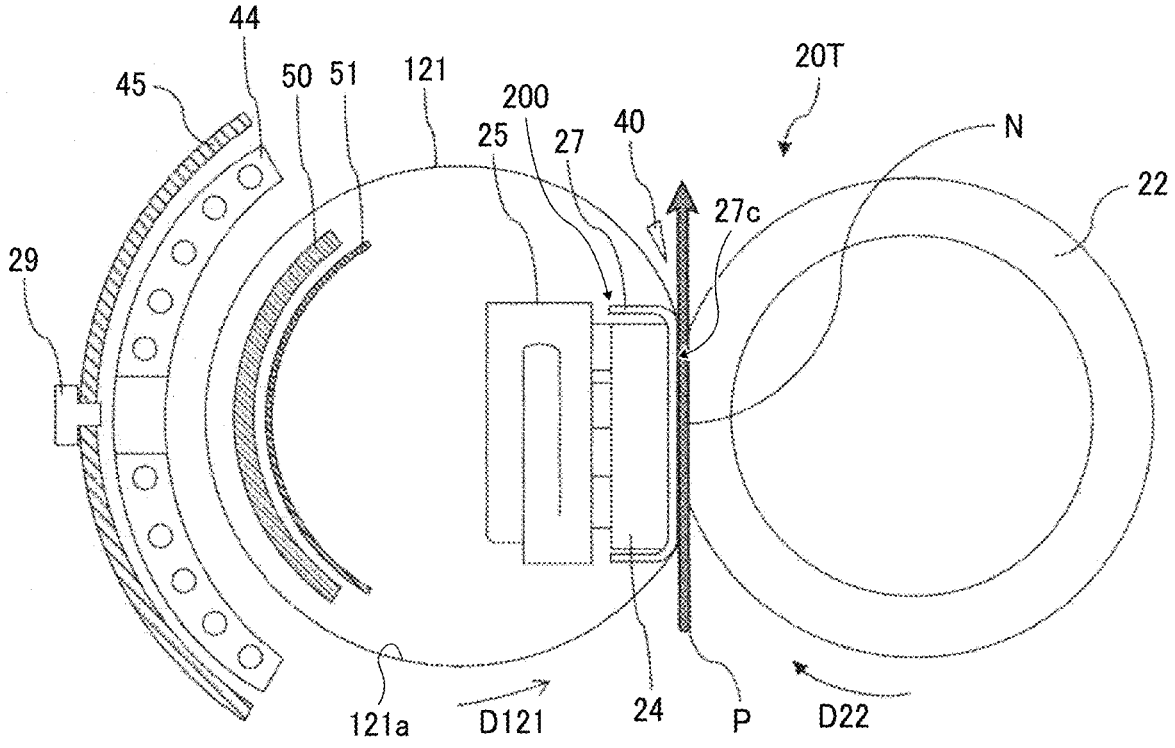
FIG. 4 is a schematic cross-sectional view of a fixing device according to yet another embodiment of the present disclosure, which is installable in the image forming apparatus depicted in FIG. 1.

Referring to FIGS. 2, 3, and 4, a description is provided of constructions of the fixing device 20, a fixing device 20S, and a fixing device 20T according to embodiments of the present disclosure, respectively.

The constructions of the fixing devices 20S and 20T, respectively, are described below after the description of the construction of the fixing device 20.

FIG. 2 is a schematic cross-sectional view of the fixing device 20 according to an embodiment of the present disclosure.

The fixing device 20 includes a fixing belt 21, a plurality of heaters 23A and 23B, a nip forming unit 200, and a pressure roller 22. The fixing belt 21 serves as a belt, an endless belt, or a fixing rotator. The pressure roller 22 serves as a pressure rotator or an opposed rotator.

The fixing belt 21 serves as the fixing rotator or the endless belt that rotates in a rotation direction D21.

The heaters 23A and 23B heat the fixing belt 21.

The nip forming unit 200 is disposed within a loop formed by the fixing belt 21.

The pressure roller 22 is pressed against the nip forming unit 200 via the fixing belt 21 to form a fixing nip N between the fixing belt 21 and the pressure roller 22. The pressure roller 22 rotates in a rotation direction D22.

Each of the fixing belt 21 and the pressure roller 22 extends in a longitudinal direction that is parallel to a rotation shall of the pressure roller 22 and is perpendicular to a paper surface in FIG. 2. Each of the fixing belt 21 and the pressure roller 22 is longer than a width of the sheet P in the longitudinal direction of each of the fixing belt 21 and the pressure roller 22. The fixing belt 21 and the pressure roller 22 sandwich and convey the sheet P.

Each of the heaters 23A and 23B is a halogen heater that is disposed inside the fixing belt 21, that is, within the loop formed by the fixing belt 21. The heaters 23A and 23B heat the fixing belt 21 with radiant heat. The heaters 23A and 23B are not limited to the halogen heaters, respectively.

The fixing device 20 further includes a plurality of reflecting plates 28A and 28B that reflects the radiant heat from the heaters 23A and 23B toward the fixing belt 21, thus facilitating heating of the fixing belt 21.

The nip forming unit 200 is disposed within the loop formed by the fixing belt 21, The nip forming unit 200 includes at least a nip former 27. The nip forming unit 200 may further include a base 24 and a stay 25.

The nip former 27 contacts an inner circumferential face 21*a* serving as an inner face of the fixing belt 21. The nip former 27 has a thickness that is not changed by pressure from the pressure roller 22 and conducts heat.

The nip former 27 includes a contact face (e.g., a fixing nip forming face 27*c*) that is disposed opposite the fixing belt 21 and an opposite face that is opposite to the contact face. The base 24 is mounted on the opposite face of the nip former 27.

The stay 25 supports and reinforces the base 24.

The nip former 27 depicted in FIG. 2 is lateral U-shaped in cross section. Alternatively, as long as the fixing nip forming face 27*c* is planar, the nip former 27 may be a plate or may have other shapes.

A description is provided of configurations of a first comparative fixing device, a second comparative fixing device, and a third comparative fixing device, respectively.

The first comparative fixing device, that shortens a warm-up time and decreases power consumption, includes an endless belt, a pressure rotator, a heater, and a nip former. The endless belt is a fixing belt. The pressure rotator is disposed outside a loop formed by the endless belt and disposed opposite the endless belt. The heater heats the endless belt. The nip former is disposed within the loop formed by the endless belt. The nip former and the pressure rotator form a fixing nip between the endless belt and the pressure rotator.

As a first method for heating an inner circumferential face of the endless belt, a pressure rotator also serving as a heater heats a back side of the fixing nip. As a second method for heating the inner circumferential face of the endless belt, a heater such as a lamp heater heats the endless belt in a span outboard from the pressure rotator. The first method decreases energy consumption. However, the first method causes the heater to heat the endless belt in a restricted span on the endless belt. Hence, if an image forming apparatus that prints at high speed employs the first method, the fixing nip is susceptible to temperature fluctuation disadvantageously. Conversely, the second method causes the heater to heat the endless belt in an increased span thereon. Hence, even if the image forming apparatus that prints at high speed employs the second method, the fixing nip retains a predetermined temperature advantageously.

The endless belt slides over the nip former via a lubricant applied between the endless belt and the nip former. Since the heater heats the endless belt to a high temperature, silicone oil, silicone grease, fluorine oil, or fluorine grease is used as the lubricant.

Since the nip former receives a substantial force from the pressure rotator while the pressure rotator presses against the nip former to fix a toner image on a recording medium, the nip former has an enhanced mechanical strength. The nip former contacts the inner circumferential face of the endless belt. Hence, the nip former has a smooth surface.

The nip former is made of aluminum that has an enhanced thermal conductivity and a decreased weight and is available at reduced costs. Since aluminum is relatively soft among metals, if aluminum is used for the nip former, the nip former is made of aluminum having an increased thickness. However, even if the nip former is made of aluminum having the increased thickness, the nip former may not satisfy market needs for high-speed image formation and an extended product life.

To address the circumstances described above, the second comparative fixing device includes a nip former made of aluminum treated with alumite processing (e.g., anodizing) on a surface of the nip former. The alumite processing is a processing method for producing an anodic oxidation coating (e.g., aluminum oxide film) on a surface of aluminum. The anodic oxidation coating produced by the alumite processing improves hardness and therefore is suitable for the nip former.

Generally, the anodic oxidation coating treated with the alumite processing is agglomerate of fine pores that extend perpendicularly from a surface, thus having an increased specific surface area. Hence, the anodic oxidation coating retains the lubricant. For example, under a condition in which toner images are fixed on recording media continuously, the anodic oxidation coating improves performance of the nip former.

The third comparative fixing device includes a nip former in which a diameter of a pore of an anodic oxidation coating is smaller than a diameter of a thickener of fluorine grease applied between the nip former and the endless belt. Accordingly, the nip former retains improved sliding of the inner circumferential face of the endless belt (e.g., film) over a surface of the nip former over a prolonged period of time, However, the nip former incorporated in each of the first comparative fixing device, the second comparative fixing device, and the third comparative fixing device may not retain improved sliding of the endless belt over the nip former, may not downsize and lighten each of the first comparative fixing device, the second comparative fixing device, and the third comparative fixing device, and may not achieve high quality image formation over a prolonged period of time.

With the configuration of the second comparative fixing device, an oil component of the lubricant applied between the nip former and the endless belt may enter the fine pores of the anodic oxidation coating gradually, causing shortage of oil or increasing viscosity of grease disadvantageously. If the second comparative fixing device suffers from shortage oil, sliding of the endless belt over the nip former may degrade substantially. As the nip former scrapes the inner circumferential face of the endless belt, the endless belt may degrade quality of a toner image fixed on a recording medium. Additionally, powder produced as the nip former scrapes the inner circumferential face of the endless belt may increase torque that rotates the endless belt sharply.

For example, if fluorine grease is used as the lubricant, the lubricant is susceptible to shortage of oil. A volume of fluorine oil as base oil varies depending on temperature substantially. Hence, when a temperature of the second comparative fixing device decreases to a temperature near a room temperature after image formation finishes, the fluorine oil enters the fine pores of the anodic oxidation coating, causing the lubricant to suffer from shortage of oil.

The anodic oxidation coating is produced by oxidation of aluminum as a base. The anodic oxidation coating has a thickness that is approximately twice as large as a thickness of an oxidized portion of aluminum in a direction perpendicular to the base. Thus, while the anodic oxidation coating is produced, a volume of the anodic oxidation coating changes substantially. Hence, the anodic oxidation coating is susceptible to variation in thickness.

According to the embodiments of the present disclosure, anodic oxidation on aluminum is referred to as alumite treatment or alumite processing, The alumite processing is a processing method for producing an anodic oxidation coating (e.g., aluminum oxide film) on a surface of aluminum. The anodic oxidation coating (e.g., the aluminum oxide film) produced by anodizing aluminum is also referred to as an alumite layer.

The anodic oxidation coating produced by the alumite processing improves hardness and therefore is suitable for the nip former. Aluminum and the anodic oxidation coating are different substantially in strength. Hence, if the anodic oxidation coating has variation in thickness, the nip former is susceptible to deformation as image formation is repeated. If the nip former is deformed, the nip former may degrade quality of a toner image fixed on a recording medium. Additionally, powder produced as the nip former scrapes the inner circumferential face of the endless belt may increase torque that rotates the endless belt sharply.

With the configuration of the third comparative fixing device, the diameter of the pore of the anodic oxidation coating is smaller than the diameter of the thickener. Hence, the lubricant is not susceptible to shortage of oil.

However, as the pore of the anodic oxidation coating is downsized, although the oil component of the lubricant applied between the nip former and the endless belt enters the fine pores of the anodic oxidation coating at a decreased speed, the lubricant may suffer from shortage of oil or viscosity of grease may increase. Accordingly, as the nip former scrapes the inner circumferential face of the endless belt, the endless belt may degrade quality of a toner image fixed on a recording medium. Additionally, powder produced as the nip former scrapes the inner circumferential face of the endless belt may increase torque that rotates the endless belt sharply.

With the configuration of the third comparative fixing device, like with the configuration of the second comparative fixing device, if the anodic oxidation coating suffers from variation in thickness, the nip former is susceptible to deformation as image formation is repeated. If the nip former is deformed, the nip former may degrade quality of a toner image fixed on a recording medium. Additionally, the nip former may scrape the inner circumferential face of the endless belt easily. Thus, powder produced as the nip former scrapes the inner circumferential face of the endless belt may increase torque that rotates the endless belt sharply.

The inventors of the present disclosure obtained information that alumite sealing sealed the pores of the anodic oxidation coating. Before and after sealing, the inventors observed and examined a surface of the anodic oxidation coating with an electron microscope. As described below with reference to FIG. 5, before sealing, the inventors found that the fine pores were disposed on an entirety on the surface of the anodic oxidation coating. Conversely, as described below with reference to FIG. 6, after sealing, the pores were mostly filled. Interiors of the pores that remained slightly were also filled.

Figure 7:
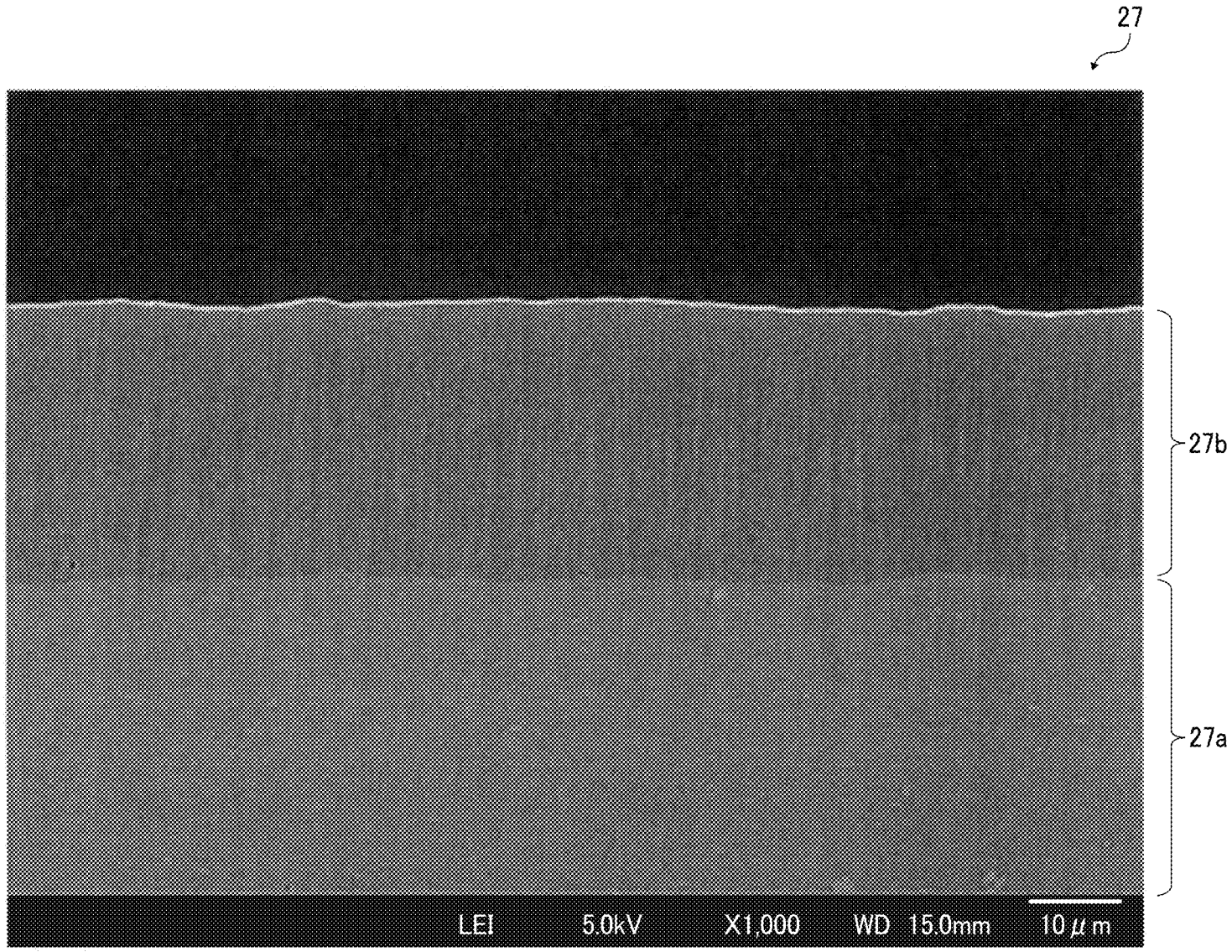
FIG. 7 is a diagram of a photograph taken with the electron microscope as another example of the anodic oxidation coating that is sealed and coats the fixing nip forming face of the nip former incorporated in the fixing device depicted in FIG. 2.

FIG. 7 illustrates an anodic oxidation coating 27*b* that is sealed and coats the fixing nip forming face 27*c* of the nip former 27 incorporated in the fixing device 20 depicted in FIG. 2. A configuration of the nip former 27 depicted in FIG. 7 is described below in detail.

A description is provided of examinations of performance of nip formers.

The inventors prepared a fixing device that employed a nip former that included an anodic oxidation coating on aluminum that was sealed. The fixing device barely suffered from shortage of oil of the lubricant applied between the nip former and an inner circumferential face of an endless belt (e.g., a fixing belt) or increase in viscosity of grease.

In order to develop the fixing device that satisfied market needs for high-speed image formation and an extended product life, the inventors examined various nip formers that included an anodic oxidation coating on aluminum that was sealed. The inventors found that the nip formers varied in performance.

The inventors examined a faulty nip former and found that a part of the faulty nip former was deformed sightly.

The inventors examined the part of the faulty nip former that suffered from slight deformation. As described above, when the anodic oxidation coating was produced on the surface of aluminum, aluminum was approximately doubled in volume and was anodized into the anodic oxidation coating. Hence, since the anodic oxidation coating was hard, if the anodic oxidation coating suffered from variation in thickness, the anodic oxidation coating suffered from accumulated mechanical stress that was not relieved by sealing. As image formation was repeated while the anodic oxidation coating suffered from the accumulated mechanical stress, a part of the faulty nip former was deformed sightly.

This phenomenon is eliminated if the thickness of aluminum increases substantially. However, if the thickness of aluminum increases, the fixing device increases in size and weight, increasing costs disadvantageously.

The inventors repeated an examination of a practical thickness of a nip former that included an anodic oxidation coating on aluminum that was sealed. The inventors have found that examination indicates that the anodic oxidation coating that applies mechanical stress to the nip former is requested to have an even thickness.

Figure 8:
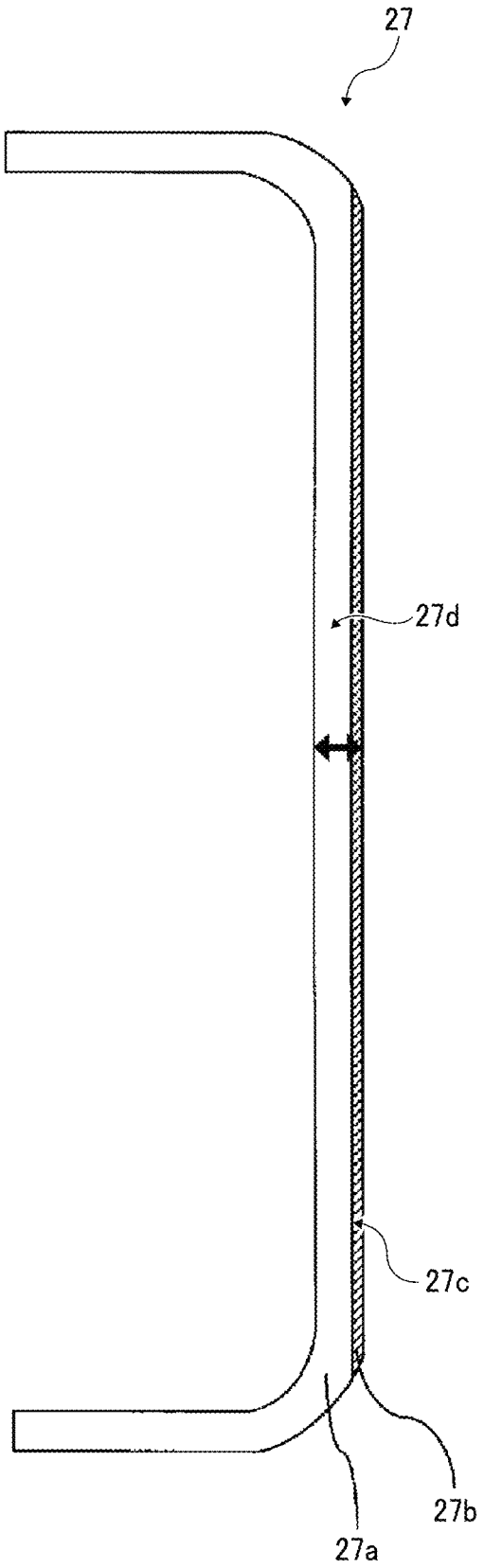
FIG. 8 is a schematic diagram of the nip former incorporated in the fixing device depicted in FIG. 2.

Referring to FIG. 8, a description is provided of a construction of the nip former 27 according to an embodiment of the present disclosure.

The nip former 27 includes a base 27*a* made of aluminum. The anodic oxidation coating 27*b* treated with sealing coats at least the fixing nip forming face 27*c*.

FIG. 8 is a schematic diagram of the nip former 27 according to an embodiment of the present disclosure. The base 27*a* is made of aluminum. The fixing nip forming face 27*c* mounts the anodic oxidation coating 27*b* treated with sealing. The nip former 27 further includes a fixing nip forming portion 27*d* (e.g., a nip forming portion) that forms or defines the fixing nip N. FIG. 8 schematically illustrates a thickness of the fixing nip forming portion 27*d* with a double-headed arrow.

Figure 9:
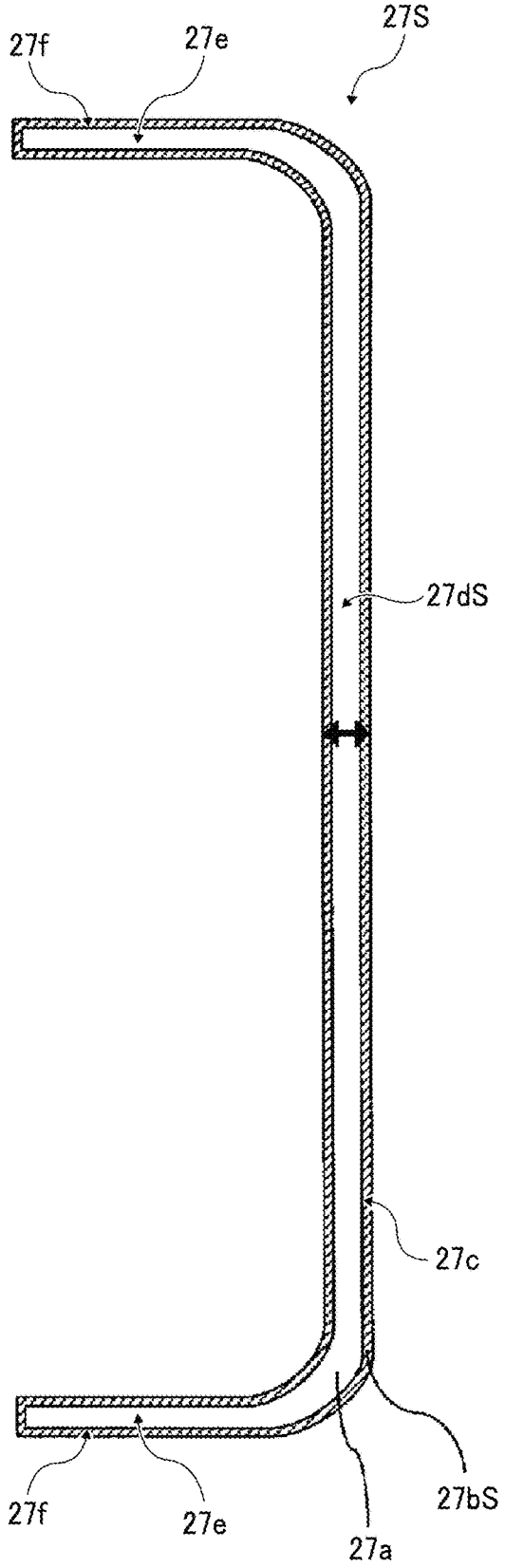
FIG. 9 is a schematic diagram of a nip former as a variation of the nip former depicted in FIG. 8.

FIG. 9 is a schematic diagram of a nip former 27S according to another embodiment of the present disclosure. The nip former 27S depicted in FIG. 9 includes an anodic oxidation coating 27*b*S treated with sealing. The anodic oxidation coating 27*b*S coats an entire surface of the base 27*a*. The nip former 27S further includes a fixing nip forming portion 27*d*S that forms or defines the fixing nip N.

Each of the fixing nip forming portions 27*d* and 27*d*S that serves as a nip forming portion that forms or defines the fixing nip N has a thickness not smaller than 0.40 mm and not greater than 1.20 mm, preferably not smaller than 0.45 mm and not greater than 1.00 mm. The thicknesses of the fixing nip forming portions 27*d* and 27*d*S include thicknesses of the anodic oxidation coatings 27*b* and 27*b*S treated with sealing, respectively.

If the thickness of each of the fixing nip forming portions 27*d* and 27*d*S is smaller than 0.40 mm, each of the fixing nip forming portions 27*d* and 27*d*S may not be planar constantly and may not retain an even temperature profile in image formation.

If the thickness of each of the fixing nip forming portions 27*d* and 27*d*S is greater than 1.20 mm, each of the nip formers 27 and 27S may increase weight and costs and may upsize the fixing device 20. Additionally, each of the fixing nip forming portions 27*d* and 27*d*S may increase a time taken to he heated to a predetermined temperature when the fixing device 20 is warmed up.

In order to define the fixing nip N precisely as the pressure roller 22 is pressed, against the nip former 27 or 27S, each of the nip formers 27 and 27S has a width (e.g., a thickness) not smaller than 10 mm and not greater than 25 mm, preferably not smaller than 15 mm and not greater than 20 mm, If the width of each of the nip formers 27 and 27S is smaller than 10 mm, each of the nip formers 27 and 27S may not define the fixing nip N precisely, degrading quality of the toner image formed on the sheet P. If the width of each of the nip formers 27 and 27S is greater than 25 mm, each of the nip formers 27 and 27S may upsize the fixing device 20. Additionally, each of the fixing nip forming portions 27*d* and 27*d*S may increase the time taken to be heated to the predetermined temperature when the fixing device 20 is warmed up.

Each of the anodic oxidation coatings 27*b* and 27*b*S coating the fixing nip forming face 27*c* has a thickness that is not smaller than 22 μm and not greater than 45 μm, preferably not smaller than 25 μm and not greater than 40 μm.

If the thickness of each of the anodic oxidation coating 27*b* in the fixing nip forming portion 27*d* and the anodic oxidation coating 27*b*S in the fixing nip forming portion 27*d*S is smaller than 22 μm, each of the anodic oxidation coatings 27*b* and 27*b*S is susceptible to variation in thickness. Hence, smoothness of each of the fixing nip forming portions 27*d* and 27*d*S deteriorates. Accordingly, as image formation is repeated, each of the fixing nip forming portions 27*d* and 27*d*S scrapes the inner circumferential face 21*a* of the fixing belt 21, generating powder that may increase torque that rotates the fixing belt 21 disadvantageously.

If the thickness of each of the anodic oxidation coating 27*b* in the fixing nip forming portion 27*d* and the anodic oxidation coating 27*b*S in the fixing nip forming portion 27*d*S is greater than 45 μm, an increased time may be taken to produce each of the anodic oxidation coatings 27*b* and 27*b*S, increasing manufacturing costs. Additionally, since smoothness of each of the fixing nip forming portions 27*d* and 27*d*S deteriorates, as image formation is repeated, each of the fixing nip forming portions 27*d* and 27*d*S scrapes the inner circumferential face 21*a* of the fixing belt 21, generating powder that may increase torque that rotates the fixing belt 21 disadvantageously.

Each of the anodic oxidation coatings 27*b* and 27*b*S coating the fixing nip forming face 27*c* has a variation in thickness that is not greater than 20 percent, preferably not smaller than 2 percent and not greater than 10 percent.

If each of the anodic oxidation coating 27*b* in the fixing nip forming portion 27*d* and the anodic oxidation coating 27*b*S in the fixing nip forming portion 27*d*S has a variation in thickness that is greater than 20 percent, smoothness of each of the fixing nip forming portions 27*d* and 27*d*S deteriorates, Accordingly, as image formation is repeated, each of the fixing nip forming portions 27*d* and 27*d*S scrapes the inner circumferential face 21*a* of the fixing belt 21, generating powder that may increase torque that rotates the fixing belt 21 disadvantageously.

As variation in thickness of each of the anodic oxidation coating 27*b* in the fixing nip forming portion 27*d* and the anodic oxidation coating 27*b*S in the fixing nip forming portion 27*d*S decreases, smoothness of each of the fixing nip forming portions 27*d* and 27*d*S improves. However, the base 27*a* made of aluminum has surface asperities before each of the anodic oxidation coatings 27*b* and 27*b*S is produced. Hence, variation in thickness of each of the anodic oxidation coatings 27*b* and 27*b*S is allowed in a certain degree. However, variation in thickness of each of the anodic oxidation coatings 27*b* and 27*b*S is not greater than 20 percent.

Each of the anodic oxidation coatings 27*b* and 27*b*S is produced by performing electrolysis in a solution with aluminum serving as an anode. Hence, a sufficient distance is provided between a nip former (e.g., the nip former 27 or 27S), serving as the anode, that incorporates the anodic oxidation coating 27*b* or 27*b*S, and a counter electrode serving as a cathode. Density of electric currents does not increase substantially when electrolysis is performed to prevent concentration of the electric currents. Accordingly, the nip formers 27 and 27S according to the embodiments of the present disclosure that satisfy conditions described above are obtained. The anodic oxidation coatings 27*b* and 27*b*S are sealed by general sealing such as pressurized steam sealing, boiling water sealing, nickel acetate sealing, and cobalt acetate sealing.

Figure 5:
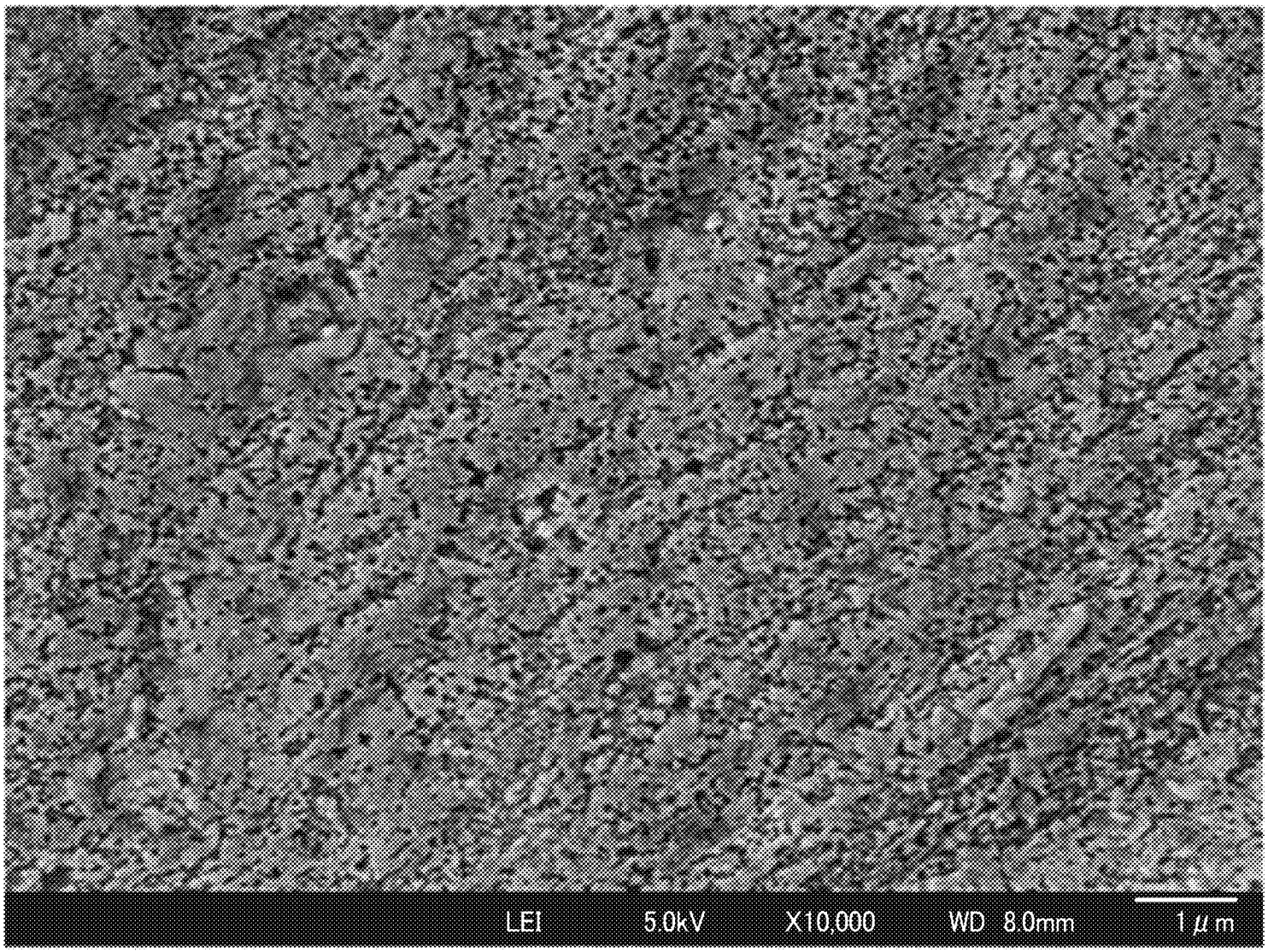
FIG. 5 is a diagram of a photograph taken with an electron microscope as an example of an anodic oxidation coating that coats a fixing nip forming face of a comparative nip former.
Figure 6:
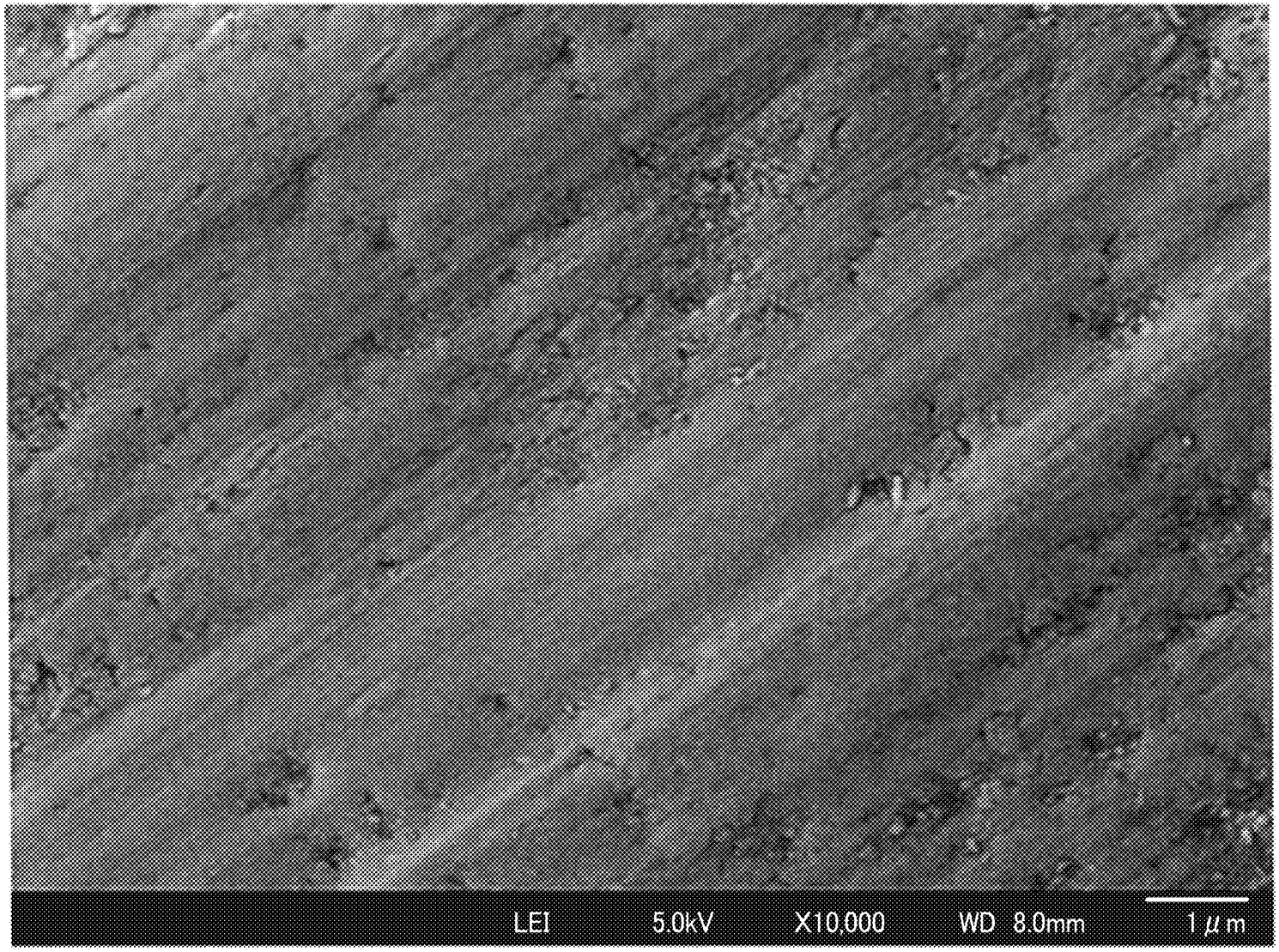
FIG. 6 is a diagram of a photograph taken with the electron microscope as an example of an anodic oxidation coating that is sealed and coats a fixing nip forming face of a nip former incorporated in the fixing device depicted in FIG. 2.

FIGS. 5 and 6 illustrate photographs taken with an electron microscope (e.g., a scanning electron microscope (SEM)) as examples of an anodic oxidation coaling (e.g., the anodic oxidation coatings 27*b* and 27*b*S) that coats a fixing nip forming face (e.g., the fixing nip forming face 27*c*) of a nip former (e.g., the nip formers 27 and 27S). FIG. 5 is a photograph taken by the electron microscope as one example of the anodic oxidation coating that is not sealed. FIG. 6 is a photograph taken by the electron microscope as one example of the anodic oxidation coating that is sealed. As illustrated in FIG. 5, before the anodic oxidation coating is sealed, the fine pores are disposed on the entirety on the surface of the anodic oxidation coating. Conversely, as illustrated in FIG. 6, after the anodic oxidation coating is sealed, the pores are mostly filled. The interiors of the pores that remain slightly are also filled. Thus, whether or not the anodic oxidation coating incorporated in a fixing nip forming portion (e.g., the fixing nip forming portions 27*d* and 27*d*S) of the nip former is sealed is determined by observation with the electron microscope.

The thickness and the variation in thickness of the anodic oxidation coating of the fixing nip forming portion of the nip former are measured by observing a cross section of the fixing nip forming portion with the SEM.

The cross section of the fixing nip forming portion is produced by various methods such as mechanical polishing, chemical etching, and dry etching. The inventors of the present disclosure prepared the cross section of the fixing nip forming portion with a Cross Section Polisher™ SM-09010 manufactured by JEOL Ltd. Since the Cross Section Polisher™ SM-09010 employs dry etching with argon ion, the Cross Section Polisher™ SM-09010 produces the cross section sharply without damaging the anodic oxidation coating.

A surface of the nip former faced up is shot to create a scanning electron microscope (SENT) image that is hereinafter referred to as a SEM image. The thickness of the anodic oxidation coating of the fixing nip forming portion is calculated as an average film thickness in a width of 100 μm of the SEM image. The variation in thickness of the anodic oxidation coating of the fixing nip forming portion is calculated by dividing a difference between a maximum value and a minimum value of a film thickness of the anodic oxidation coating in the width of 100 μm of the SEM image, which is obtained by shooting the surface of the nip former faced up, by the average film thickness.

The thickness and the variation in thickness of the anodic oxidation coating of the fixing nip forming portion are measured at an increased number of positions on the fixing nip forming portion. However, measurement at three positions is sufficient. If a manufacturing method for manufacturing the nip former is stabilized, measurement at a single position is sufficient. If measurement is performed at a plurality of positions, the thickness and the variation in thickness of the anodic oxidation coating are requested to be within ranges described above according to the embodiments of the present disclosure at the plurality of positions. The thickness and the variation in thickness of the anodic oxidation coating according to the embodiments of the present disclosure and comparative examples define average values of measurement values measured at three positions on the fixing nip forming portion.

FIG. 7 illustrates the SEM image in cross section of the fixing nip forming portion 27*d* of the nip former 27 according to the embodiment of the present disclosure. As illustrated in FIG. 7, an interface between the base 27*a* made of aluminum and the anodic oxidation coating 27*b* is recognized clearly. FIG. 7 illustrates the anodic oxidation coating 27*b* treated with sealing. The anodic oxidation coating 27*b* depicted in FIG. 7 as one example has a thickness of 31.1 μm and a variation in thickness of 9.0 percent.

The thickness and the variation in thickness of the anodic oxidation coating 27*b* are measured at a plurality of positions on the fixing nip forming portion 27*d* to obtain an average value of measurement values measured at the plurality of positions. The thickness and the variation in thickness of the anodic oxidation coating 27*b* were measured at another two positions on the fixing nip forming portion 27*d* of the nip former 27 depicted in FIG. 7. As a result, the anodic oxidation coating 27*b* had thicknesses of 31.2 μm and 31.1 μm, respectively, and variations in thickness of 9.0 percent and 8.9 percent, respectively. Thus, the anodic oxidation coating 27*b* had an even thickness.

A description is provided of a supplementation for the nip former 27 depicted in FIG. 7.

As described above, according to measurement for the nip former 27 depicted in FIG. 7, the anodic oxidation coating 27*b* had a thickness of 31.1 μm and a variation in thickness of 9.0 percent, satisfying the conditions of the embodiment of the present disclosure. When measurement was performed at another two positions on the nip former 27, as described above, the anodic oxidation coating 27*b* had thicknesses of 31.2 μm and 31.1 μm, respectively, and variations in thickness of 9.0 percent and 8.9 percent, respectively. An average value of the thicknesses measured at the plurality of positions is calculated by averaging 31.1 μm, 31.2 μm, and 31.1 μm. An average value of the variations in thickness measured at the plurality of positions is calculated by averaging 9.0 percent, 9.0 percent, and 8.9 percent. According to the embodiments of the present disclosure, the average values are calculated as described above.

The anodic oxidation coatings 27*b* and 27*b*S of the fixing nip forming portions 27*d* and 27*d*S of the nip formers 27 and 27S according to the embodiments of the present disclosure, respectively, are sealed as described above. The anodic oxidation coatings 27*b* and 27*b*S are sealed by a typical sealing method. The anodic oxidation coatings 27*b* and 27*b*S that are sealed prevent the lubricant applied between the nip former 27 and the inner circumferential face 21*a* of the fixing belt 21 and the lubricant applied between the nip former 27S and the inner circumferential face 21*a* of the fixing belt 21, respectively, from suffering from shortage of oil or increase in viscosity of grease.

As described above with reference to FIG. 9, the anodic oxidation coating 27*b*S treated with sealing coats a surface of the nip former 27S also in outboard portions 27*e* that are other than and disposed outboard from the fixing nip forming portion 27*d*S. In other words, the anodic oxidation coating 27*b*S treated with sealing also coats outboard faces 27*f* of the nip former 27S, which are other than and disposed outboard from the fixing nip forming face 27*c*.

Accordingly, the anodic oxidation coating 27*b*S relieves mechanical stress caused by change in volume of the nip former 27S when the anodic oxidation coating 27*b*S is produced. The thickness and the variation in thickness of the anodic oxidation coating 27*b*S coating the outboard faces 27*f* are not managed specially unless the anodic oxidation coating 27*b*S has an excessively increased thickness. The anodic oxidation coating 27*b*S coating the outboard faces 27*f* relieves mechanical stress sufficiently.

The anodic oxidation coatings 27*h* and 27*b*S of the nip formers 27 and 27S, which are treated with sealing, may mount a coating that facilitates sliding of the fixing belt 21, improves corrosion resistance, and holds grease with a physical shape. The coating includes a filler and a binder. The filler is made of a carbon material, graphite, polytetrafluoroethylene, boron nitride, or the like and contains a solid lubricant such as molybdenum sulfide. The binder is made of heat-resistant resin such as polyamideimide resin, epoxy resin, and acrylic resin.

The lubricant made of heat-resistant oil such as silicone oil and fluorine oil, silicone grease, fluorine grease, or the like is applied between the fixing belt 21 and a contact face of each of the nip formers 27 and 27S, which is disposed opposite the fixing belt 21. Fluorine grease is used in view of chemical stability and heat resistance.

Since the fixing device 20 depicted in FIG. 2 does not have particular space that stores fluorine grease, the fixing device 20 does not supply the fluorine grease excessively, reducing an amount of usage of the expensive fluorine grease and achieving an economic advantage.

According to the embodiments, as illustrated in FIG. 2, the base 24 extending throughout an entire span of the fixing belt 21 in an axial direction, that is, the longitudinal direction, thereof is secured to and supported by the stay 25. Accordingly, the stay 25 prevents the base 24 from being bent by pressure from the pressure roller 22, causing the base 24 to form the fixing nip N that has a uniform nip length in the sheet conveyance direction of the sheet P throughout an entire span of the pressure roller 22 in an axial direction, that is, the longitudinal direction, thereof.

The base 24 is made of a heat-resistant material that has heat resistance of 200 degrees Celsius and enhanced mechanical strength, for example, heat-resistant resin such as polyimide (PI) resin, polyether ether ketone (PEEK) resin, and the resins reinforced with glass fiber. Accordingly, the base 24 is immune from thermal deformation in a toner fixing temperature range in which a toner image formed on a sheet P is fixed on the sheet P, stabilizing the fixing nip N and quality of the toner image output on the sheet P.

Both lateral ends of the stay 25 and the heaters 23A and 23B in a longitudinal direction thereof are secured to and supported by side plates of the fixing device 20 or holders separated from the side plates, respectively. The fixing device 20 further includes a separation unit 40 and a non-contact temperature detector 29 as described below A description is provided of a construction of the fixing belt 21.

The fixing belt 21 is an endless belt or film made of metal such as nickel and stainless used steel (SUS) or a resin material such as polyimide.

The fixing belt 21 includes a base layer and a release layer. The release layer serves as a surface layer made of perfluoroalkoxy alkane (PFA), polytetrafluoroethylene (PTFE), or the like. The release layer facilitates separation of the sheet P from the fixing belt 21 and prevents toner of the toner image on the sheet P from adhering to the fixing belt 21.

The fixing belt 21 may further include an elastic layer that is made of silicone rubber or the like and interposed between the base layer and the release layer. If the fixing belt 21 does not incorporate the elastic layer, the fixing belt 21 attains a decreased thermal capacity that improves a fixing property of being heated quickly. However, when the pressure roller 22 presses and deforms an unfixed toner image to fix the toner image on the sheet P, slight surface asperities of the fixing belt 21 may be transferred onto the toner image, causing a disadvantage that an orange peel mark remains on a solid part of the toner image as uneven gloss of the toner image or an orange peel image. In order to prevent the disadvantage, the fixing belt 21 incorporates the elastic layer having a layer thickness of 100 μm or greater. As the elastic layer deforms, the elastic layer absorbs the slight surface asperities, preventing the orange peel mark on the toner image.

The fixing belt 21 incorporated in the fixing device 20S described below with reference to FIG. 3 also has a construction equivalent to the construction described above.

A description is provided of a construction of the pressure roller 22.

The pressure roller 22 includes a core metal, an elastic rubber layer, and a release layer. For example, the elastic rubber layer is disposed on an outer periphery of the core metal. The release layer serves as a surface layer that facilitates separation of the sheet P from the pressure roller 22. The release layer is made of PFA, PTFE, or the like.

For example, the fixing device 20 includes a spring or the like that presses the pressure roller 22 against the fixing belt 21. As the spring presses and deforms the elastic rubber layer of the pressure roller 22, the pressure roller 22 forms the fixing nip N having a predetermined nip length in the sheet conveyance direction of the sheet P. The image forming apparatus 1 includes a driver such as a motor that generates a driving force. As the driving force is transmitted to the pressure roller 22 through a gear, the pressure roller 22 rotates in the rotation direction D22.

The pressure roller 22 may be a solid roller or a hollow roller. If the pressure roller 22 is the hollow roller, the pressure roller 22 may accommodate a heater such as a halogen heater.

The elastic rubber layer may be made of solid rubber. Alternatively, if no heater is disposed inside the pressure roller 22, sponge rubber may be used. The sponge rubber enhances thermal insulation of the pressure roller 22, causing the pressure roller 22 to draw less heat from the fixing belt 21.

The pressure roller 22 incorporated in the fixing devices 20S and 22T described. below with reference to FIGS. 3 and 4, respectively, also has a construction equivalent to the construction described above.

FIG. 3 is a cross-sectional view of the fixing device 20S according to another embodiment of the present disclosure, illustrating a construction of the fixing device 20S.

The fixing device 20S includes the pressure roller 22 serving as a pressure rotator, the fixing belt 21 serving as a belt or an endless belt, and a heater 23 (e.g., a halogen heater) that heats the inner circumferential face 21*a* of the fixing belt 21 directly with radiant heat. The nip forming unit 200 is disposed within the loop formed by the fixing belt 21.

The nip forming unit 200 includes at least the nip former 27. The nip forming unit 200 may further include the base 24 and the stay 25.

The nip former 27 contacts the inner circumferential face 21*a* of the fixing belt 21. The nip former 27 has a thickness that is not changed by pressure from the pressure roller 22 and conducts heat.

The nip former 27 includes the contact face (e.g., the fixing nip forming face 27*c*) that is disposed opposite the fixing belt 21 and the opposite face that is opposite to the contact face. The base 24 is mounted on the opposite face of the nip former 27.

The stay 25 supports and reinforces the base 24.

According to the embodiment, the base 24 extending throughout the entire span of the fixing belt 21 in the axial direction, that is, the longitudinal direction, thereof is secured to and supported by the stay 25. Accordingly, the stay 25 prevents the base 24 from being bent by pressure from the pressure roller 22, causing the base 24 to form the fixing nip N that has the uniform nip length in the sheet conveyance direction of the sheet P throughout the entire span of the pressure roller 22 in the axial direction, that is, the longitudinal direction, thereof.

The base 24 of the fixing device 20S depicted in FIG. 3 may include a heating mechanism. In this case, output of the heater 23 may decrease. Alternatively, the heater 23 may be removed.

FIG. 4 is a cross-sectional view of the fixing device 20T according to yet another embodiment of the present disclosure, illustrating a construction of the fixing device 20T, The fixing device 20T mainly includes a fixing belt 121, an induction heating (IH) coil unit 44 serving as an external induction heater, the pressure roller 22, and the separation unit 40.

The nip forming unit 200 is disposed within a loop formed by the fixing belt 121.

The nip forming unit 200 includes at least the nip former 27. The nip forming unit 200 may further include the base 24 and the stay 25.

The nip former 27 contacts an inner circumferential face 121*a* of the fixing belt 121. The nip former 27 has a thickness that is not changed by pressure from the pressure roller 22 and conducts heat.

The nip former 27 includes the contact face (e.g., the fixing nip forming face 27*c*) that is disposed opposite the fixing belt 121 and the opposite face that is opposite to the contact face. The base 24 is mounted on the opposite face of the nip former 27.

The stay 25 supports and reinforces the base 24.

The fluorine grease described above is applied between the fixing belt 121 and the contact face (e.g., the fixing nip forming face 27*c*) of the nip former 27. For example, the fluorine grease described above is applied to an entirety of the contact face (e.g., the fixing nip forming face 27*c*) of the nip former 27, which is disposed opposite the fixing belt 121.

According to the embodiment, the base 24 extending throughout an entire span of the fixing belt 121 in an axial direction, that is, a longitudinal direction, thereof is secured to and supported by the stay 25. Accordingly, the stay 25 prevents the base 24 or the nip former 27 from being bent by pressure from the pressure roller 22, causing the base 24 to form the fixing nip N that has the uniform nip length in the sheet conveyance direction of the sheet P throughout the entire span of the pressure roller 22 in the axial direction, that is, the longitudinal direction, thereof.

Like the pressure roller 22 of the fixing device 20 described above, the driver drives and rotates the pressure roller 22 in the rotation direction D22. The fixing belt 121 also rotates in a rotation direction D121 in accordance with rotation of the pressure roller 22.

The fixing belt 121 has a construction that suits for an induction heating fixing method. For example, the fixing belt 121 is an endless belt having a multi-layer structure constructed of a base layer, a heat generating layer, a complex function layer, an elastic layer, and a release layer. The base layer is an inner layer that mounts the heat generating layer that mounts the complex function layer that mounts the elastic layer that mounts the release layer.

According to the embodiment, the base layer, the heat generating layer, the complex function layer, the elastic layer, and the release layer have configurations described below, respectively, for example. Alternatively, the base layer, the heat generating layer, the complex function layer, the elastic layer, and the release layer may have other configurations, respectively.

The base layer has a diameter of 30 mm and is made of seamless polyimide. The heat generating layer is made of copper as thin non-magnetic metal. The complex function layer is made of nickel. The elastic layer is made of silicone rubber. The release layer is made of PFA. The release layer facilitates separation of toner of the toner image formed on the sheet P.

The fixing belt 121 has an overall thickness of approximately 300 μm.

The fixing device 20T further includes a thermosensitive magnetic alloy 50 and a magnetic field shielding plate 51 made of aluminum, which are disposed within the loop formed by the fixing belt 121 and disposed opposite the IH coil unit 44. The thermosensitive magnetic alloy 50 does not contact the fixing belt 121.

As illustrated in FIG. 4, the IH coil unit 44 is disposed outside the loop formed by the fixing belt 121 and disposed opposite the fixing nip N via the nip former 27.

The fixing device 201 further includes a soft ferrite 45. With the induction heating fixing method employed by the fixing device 20T, two ferromagnets, that is, the soft ferrite 45 and the thermosensitive magnetic alloy 50, sandwich the fixing belt 121 for induction heating and the IH coil unit 44. According to the embodiment, the IH coil unit 44 generates a magnetic flux that is converted into thermal energy effectively, thus heating the fixing belt 121.

In the fixing device 20T according to the embodiment, the fixing belt 121 and the pressure roller 22 convey the sheet P through the fixing nip N where the fixing belt 121 contacts the pressure roller 22. The separation unit 40 may be disposed downstream from an exit of the fixing nip N in the sheet conveyance direction of the sheet P. The separation unit 40 guides the sheet P that is conveyed and separates the sheet P from the fixing belt 121.

The non-contact temperature detector 29 may be disposed in proximity to the IH coil unit 44. The non-contact temperature detector 29 detects a temperature of a surface of the fixing belt 121. The fixing device 20T according to the embodiment further includes a controller that controls the IH coil unit 44 to adjust the temperature of the surface of the fixing belt 121 to a fixing temperature based on the temperature of the surface of the fixing belt 121, which is detected by the non-contact temperature detector 29.

The fixing devices 20, 20S, and 20T depicted in FIGS. 2, 3, and 4, respectively, employ a heating method for heating the fixing belt 21 or 121. Alternatively, the fixing devices 20, 20S, and 20T may employ a heating method for heating the nip former 27, also achieving proper performance.

A description is provided of first to eighth embodiments of the present disclosure.

The following describes the technology of the present disclosure in detail with the first to eighth embodiments. However, the technology of the present disclosure is not limited to the first to eighth embodiments.

A description is provided of the first embodiment and the second embodiment along with a first comparative example and a second comparative example.

A fixing device was removed from a color laser printer SP C840 manufactured by Ricoh Co., Ltd. and the fixing device 20 depicted in FIG. 2 was installed into the color laser printer SP C840 to produce a testing machine.

A description is provided of the first embodiment.

The fixing device 20 employed the nip former 27S depicted in FIG. 9. The nip former 27S included the base 27*a* made of aluminum and the anodic oxidation coating 27*b*S (e.g., the alumite treatment) that was sealed and coated the entire surface of the base 27*a*. The nip former 27S included the fixing nip forming portion 27*d*S that was treated with the alumite treatment and boiling water sealing. The fixing nip forming portion 27*d*S had a thickness of 0.65 mm, The anodic oxidation coating 27*b*S (e.g., the alumite layer) was sealed and disposed in the fixing nip forming portion 27*d*S of the nip former 27S. The anodic oxidation coating 27*b*S had a thickness of 32.2 μm and a variation in thickness of 11.0 percent.

Fluorine grease was applied at a slide portion between the nip former 27S and the inner circumferential face 21*a* of the fixing belt 21, which slid over the nip former 27S. The fluorine grease was applied in an application amount in a range of from 10 mg/cm$^2$ to 45 mg/cm$^2$ per application unit area. The fixing device 20 applied with the fluorine grease was installed into the color laser printer SP C840. A running test was performed at a temperature of 12 degrees Celsius. The running test was performed by repeating a set of printing 5 sheets continuously for a plurality of times with an interval of 50 seconds. Change in torque of the fixing belt 21 was measured. The torque was measured with a torque detector SS-050 manufactured by Ono Sokki Co., Ltd. Based on the change in torque of the fixing belt 21, whether or not a specified number of sheets, that is, 300,000 sheets, was printed was evaluated. High quality images were formed on the specified number of sheets also.

A description is provided of the first comparative example.

According to the first embodiment, a first comparative nip former was produced as below The first comparative nip former included a base. An entire surface of the base of the first comparative nip former was treated with the alumite treatment and was not sealed.

The first comparative nip former included a fixing nip forming portion that had a thickness of 0.65 mm. An alumite layer was disposed in the fixing nip forming portion of the first comparative nip former. The alumite layer had a thickness of 40.9 μm and a variation in thickness of 20.5 percent.

The first comparative nip former was installed in an image forming apparatus (e.g., the color laser printer SP 0840) that had a construction similar to a construction of the color laser printer SP C840 according to the first embodiment. However, the image forming apparatus incorporated the first comparative nip former.

A running test was performed with the image forming apparatus incorporating the first comparative nip former. Before the image forming apparatus printed. the specified number of sheets, torque of the fixing belt 21 increased and the image forming apparatus interrupted image formation. When the image forming apparatus interrupted image formation, a fixing device incorporated therein was examined. Fluorine grease was not applied at a part of a slide portion between the first comparative nip former and the inner circumferential face 21*a* of the fixing belt 21, which slid over the first comparative nip former. The first comparative nip former scraped the inner circumferential face 21*a* of the fixing belt 21 strongly.

A description is provided of the second embodiment.

The fixing device 20 employed the nip former 27S depicted in FIG. 9 that included the base 27*a* made of aluminum. Like in the first embodiment, the anodic oxidation coating 27*b*S (e.g., the alumite treatment) that was sealed coated the entire surface of the base 27*a*.

According to the second embodiment, in anodizing (e.g., the alumite treatment) and sealing according to the first embodiment, production conditions such as a thickness of the nip former 27S, an electric current value fix anodizing, and a time for anodizing before the alumite treatment and sealing were changed to obtain a thickness and a variation in thickness of the anodic oxidation coating 27*b*S as below.

The fixing nip forming portion 27*d*S of the nip former 27S had a thickness of 0.46 mm. The anodic oxidation coating 27*b*S (e.g., the alumite layer) was sealed and disposed in the fixing nip forming portion 27*d*S of the nip former 27S. The anodic oxidation coating 27*b*S had a thickness of 23.2 μm and a variation in thickness of 16.8 percent.

The nip former 27S was installed in an image forming apparatus (e.g., the color laser printer SP C840) that had a construction similar to the construction of the color laser printer SP C840 according to the first embodiment. However, the image forming apparatus incorporated the nip former 27S according to the second embodiment.

A running test was performed with the image forming apparatus incorporating the nip former 27S according to the second embodiment. High quality images were formed on the specified number of sheets also.

A description is provided of the second comparative example.

The second comparative example used a fixing device that employed a second comparative nip former according to the second comparative example including a base, an anodic oxidation coating, and a fixing nip forming portion. The base was made of aluminum. The anodic oxidation coating (e.g., the alumite treatment) was sealed like in the first embodiment and was disposed in the fixing nip forming portion.

The fixing nip forming portion of the second comparative nip former had a thickness of 0.39 mm. The anodic oxidation coaling (e.g., the alumite layer) was sealed and disposed in the fixing nip forming portion of the second comparative nip former. The anodic oxidation coating had a thickness of 45.5 μm and a variation in thickness of 23.8 percent.

The second comparative nip former was installed in an image forming apparatus (e.g., the color laser printer SP C840) that had a construction similar to the construction of the color laser printer SP C840 according to the first embodiment. However, the image forming apparatus incorporated the second comparative nip former.

A running test was performed with the image forming apparatus incorporating the second comparative nip former. Before the image forming apparatus printed the specified. number of sheets, torque of the fixing belt 21 increased and the image forming apparatus interrupted image formation. When the image forming apparatus interrupted image formation, the fixing device incorporated therein was examined. The second comparative nip former scraped the inner circumferential face 21*a* of the fixing belt 21.

A toner image formed by the image forming apparatus suffered from obvious uneven gloss and degraded image quality.

A description is provided of the third to seventh embodiments along with a third comparative example.

As a nip former installed in a fixing device used in the third to seventh embodiments and the third comparative example, the nip former 27 depicted in FIG. 8, the nip former 27S depicted in FIG. 9, or a third comparative nip former according to the third comparative example indicated in tables 1A and 1B below was installed in an image forming apparatus (e.g., the color laser printer SP C840) that had a construction similar to the construction of the color laser printer SP C840 according to the first embodiment. However, the image forming apparatus incorporated the nip former 27, the nip former 27S, or the third comparative nip former indicated in tables 1A and 1B. Running tests were performed. Tables 1A and 1B illustrate results of the running tests.

TABLE 1A

| | Thickness of | Anodic oxidation coating of fixing nip forming portion | |
|---|---|---|---|
| | fixing nip forming portion [mm] | Thickness [μm] | Variation in thickness [%] |
| First embodiment | 0.65 | 32.2 | 11.0 |
| Second embodiment | 0.46 | 23.2 | 16.8 |
| Third embodiment | 1.18 | 44.3 | 9.8 |
| Fourth embodiment | 0.92 | 35.9 | 7.3 |
| Fifth embodiment | 0.78 | 36.1 | 19.8 |

TABLE 1A-continued

| | Thickness of fixing nip forming portion [mm] | Anodic oxidation coating of fixing nip forming portion Thickness [μm] | Variation in thickness [%] |
|---|---|---|---|
| Sixth embodiment | 0.57 | 39.2 | 11.6 |
| Seventh embodiment | 0.56 | 38.3 | 10.1 |
| First comparative example | 0.65 | 40.9 | 20.5 |
| Second comparative example | 0.39 | 45.5 | 23.8 |
| Third comparative example | 1.28 | 48.7 | 22.4 |

TABLE 1B

| | Sealing | Location of anodic oxidation coating | Evaluation for printing sheets of specified number of 300,000 |
|---|---|---|---|
| First embodiment | Yes | Entire surface of base of nip former | A |
| Second embodiment | Yes | Entire surface of base of nip former | B |
| Third embodiment | Yes | Entire surface of base of nip former | A |
| Fourth embodiment | Yes | Entire surface of base of nip former | A |
| Fifth embodiment | Yes | Entire surface of base of nip former | B |
| Sixth embodiment | Yes | Entire surface of base of nip former | A |
| Seventh embodiment | Yes | Fixing nip forming portion of nip former | B |
| First comparative example | No | Entire surface of base of nip former | C |
| Second comparative example | Yes | Fixing nip forming portion of nip former | C |
| Third comparative example | No | Entire surface of base of nip former | C |

In tables 1A and 1B, evaluations A, B, and C indicate the results of the running tests as below A: Being successful in printing the specified number of sheets easily B: Being successful in printing the specified number of sheets C: Being unsuccessful in printing the specified number of sheets The evaluation A of being successful in printing the specified number of sheets easily as described above indicates a state in which degradation in image quality does not occur even if the specified number of sheets (e.g., 300,000 sheets) is printed.

The evaluation B of being successful in printing the specified number of sheets indicates a state in which, although lightened color and color registration error appear slightly within the specified number of sheets e.g., 300,000 sheets) that is printed, image quality is acceptable.

The evaluation C of being unsuccessful in printing the specified number of sheets indicates a state in which an unacceptable, faulty toner image appears within the specified number of sheets (e.g., 300,000 sheets) that is printed or a state in which paper jam occurs and printing is interrupted.

A description is provided of the eighth embodiment.

In the eighth embodiment, a fixing device was removed from a color laser printer SP C841 manufactured by Ricoh Co., Ltd. and the fixing device 20T depicted in FIG. 4 was installed into the color laser printer SP C841 to produce a testing machine.

The fixing device 20T employed the nip former 27S employed by the fixing device 20 according to the first embodiment. An entire surface of the nip former 27S, which was disposed opposite the fixing belt 121, was applied with fluorine grease in an application amount in a range of from 10 mg/cm$^2$ to 45 mg/cm$^2$ per application unit area. The fixing device 20T applied with the fluorine grease was installed into the color laser printer SP C841. A running test was performed at a temperature of 30 degrees Celsius. The running test was performed by repeating a set of printing 18 sheets continuously for a plurality of times with an interval of 110 seconds. Change in torque of the fixing belt 121 was measured. The torque was measured with the torque detector SS-050 manufactured by Ono Sokki Co., Ltd. Based on the change in torque of the fixing belt 121, whether or not the specified number of sheets, that is, 300,000 sheets, was printed was evaluated. An evaluation result was being successful in printing the specified number of sheets easily. High quality toner images were formed on the specified number of sheets.

A description is provided of advantages of a nip former (e.g., the nip formers 27 and 27S) according to the embodiments of the present disclosure.

As illustrated in FIGS. 2, 3, 4, 8, and 9, the nip former (e.g., the nip formers 27 and 27S) according to the embodiments of the present disclosure is installed in a fixing device (e.g., the fixing devices 20, 20S, and 20T). The fixing device includes an endless belt (e.g., the fixing belts 21 and 121), a pressure rotator (e.g., the pressure roller 22), a heater (e.g., the heaters 23A, 23B, and 23 and the IH coil unit 44), and the nip former. The pressure rotator is disposed outside a loop formed by the endless belt and disposed opposite the endless belt. The heater heats the endless belt. The nip former is disposed within the loop formed by the endless belt. The nip former and the pressure rotator form a nip (e.g., the fixing nip N) between the endless belt and the pressure rotator. The nip former includes a base (e.g., the base 27*a*) made of aluminum and an anodic oxidation coating (e.g., the anodic oxidation coatings 27*b* and 27*b*S). The base has a nip forming face (e.g., the fixing nip forming face 27*c*) that forms the nip. The anodic oxidation coating is treated with sealing and coats at least the nip forming face. The base and the anodic oxidation coating define a nip forming portion (e.g., the fixing nip forming portions 27*d* and 27*d*S) that is disposed opposite the nip and defines the nip, The nip forming portion has a thickness that is not smaller than 0.40 mm and not greater than 1.20 mm. The anodic oxidation coating that coats the nip forming face and is sealed has a thickness that is not smaller than 22 μm and not greater than 45 μm. The anodic oxidation coating has a variation in thickness that is not greater than 20 percent, Accordingly, the nip former retains improved sliding of the endless belt over the nip former. As the nip former is installed in the fixing device, the nip former downsizes and lightens the fixing device, and causes the fixing device to achieve high quality image formation over a prolonged period of time.

In addition to the nip forming face of the base of the nip former, the anodic oxidation coating treated with sealing may also coat an opposite face of the base of the nip former, which is opposite to the nip forming face, and side faces of the base of the nip former.

The nip former according to the embodiments of the present disclosure is installed in the fixing device and an image forming apparatus (e.g., the image forming apparatus 1). The nip former according to the embodiments of the present disclosure downsizes and lightens the fixing device and the image forming apparatus, and causes the fixing device and the image forming apparatus to achieve high quality image formation over a prolonged period of time.

According to the embodiments described above, each of the fixing belts 21 and 121 serves as an endless belt. Alternatively, a fixing film, a fixing sleeve, or the like may be used as an endless belt. Further, the pressure roller 22 serves as a pressure rotator. Alternatively, a pressure belt or the like may be used as a pressure rotator.

According to the embodiments described above, the image forming apparatus 1 is a printer. Alternatively, the image forming apparatus 1 may be a copier, a facsimile machine, a multifunction peripheral (MFP) having at least two of copying, printing, scanning, facsimile, and plotter functions, or the like.

The above-described embodiments are illustrative and do not limit the present invention. Thus, numerous additional modifications and variations are possible in light of the above teachings. For example, elements and/or features of different illustrative embodiments max be combined with each other and/or substituted for each other within the scope of the present invention.

The invention claimed is:

1. A nip former for forming a nip between an endless belt and a pressure rotator, the nip former comprising:

a base being made of aluminum and having a nip forming face disposed opposite the nip; and an anodic oxidation coating treated with sealing and configured to coat at least the nip forming face, the anodic oxidation coating having a thickness being not smaller than 22 μm and not greater than 45 μm and a variation in thickness being not greater than 20 percent, the base and the anodic oxidation coating defining a nip forming portion disposed opposite the nip, the nip forming portion having a thickness being not smaller than 0.40 mm and not greater than 1.20 mm.

2. The nip former according to claim 1, wherein the base further has an outboard face disposed outboard from the nip forming face, and wherein the anodic oxidation coating treated with sealing is configured to coat the outboard face.

3. A fixing device comprising:

an endless belt formed into a loop;

a pressure rotator disposed outside the loop formed by the endless belt and disposed opposite the endless belt;

a heater configured to heat the endless belt; and a nip former disposed within the loop formed by the endless belt, the nip former configured to form a fixing nip between the endless belt and the pressure rotator, the nip former including:

a base being made of aluminum and having a fixing nip forming face disposed opposite the fixing nip; and an anodic oxidation coating treated with sealing and configured to coat at least the fixing nip forming face, the anodic oxidation coating having a thickness being not smaller than 22 μm and not greater than 45 μm and a variation in thickness being not greater than 20 percent, the base and the anodic oxidation coating defining a fixing nip forming portion disposed opposite the fixing nip, the fixing nip forming portion having a thickness being not smaller than 0.40 mm and not greater than 1.20 mm.

4. The fixing device according to claim 3, wherein the endless belt has an inner face disposed opposite the nip former, and wherein a lubricant is applied between the nip former and the inner face of the endless belt.

5. The fixing device according to claim 3, wherein the nip former includes a plate.

6. The fixing device according to claim 3, wherein the pressure rotator includes a roller.

7. An image forming apparatus comprising:

an image forming device configured to form an image; and a fixing device configured to fix the image on a recording medium, the fixing device comprising:

an endless belt formed into a loop;

a pressure rotator disposed outside the loop formed by the endless belt and disposed opposite the endless belt;

a heater configured to heat the endless belt; and a nip former disposed within the loop formed by the endless belt, the nip former configured to form a fixing nip between the endless belt and the pressure rotator, the nip former including:

a base being made of aluminum and having a fixing nip forming face disposed opposite the fixing nip; and an anodic oxidation coating treated with sealing and configured to coat at least the fixing nip forming face, the anodic oxidation coating having a thickness being not smaller than 22 μm and not greater than 45 μm and a variation in thickness being not greater than 20 percent, the base and the anodic oxidation coating defining a fixing nip forming portion disposed opposite the fixing nip, the fixing nip forming portion having a thickness being not smaller than 0.40 mm and not greater than 1.20 mm.

* * * * *